US011559184B2

(12) United States Patent
Rai

(10) Patent No.: US 11,559,184 B2
(45) Date of Patent: Jan. 24, 2023

(54) INTEGRATED CHEMICAL DELIVERY AND CLEANING SYSTEMS

(71) Applicant: Manichan Rai, West Palm Beach, FL (US)

(72) Inventor: Manichan Rai, West Palm Beach, FL (US)

( * ) Notice: Subject to any disclaimer, the term of this patent is extended or adjusted under 35 U.S.C. 154(b) by 190 days.

(21) Appl. No.: 17/104,212

(22) Filed: Nov. 25, 2020

(65) Prior Publication Data

US 2021/0161354 A1 Jun. 3, 2021

Related U.S. Application Data

(60) Provisional application No. 62/941,921, filed on Nov. 29, 2019.

(51) Int. Cl.
*A47L 13/17* (2006.01)

(52) U.S. Cl.
CPC ..... *A47L 13/17* (2013.01)

(58) Field of Classification Search
CPC ..... A47L 13/10; A47L 13/12; A47L 13/17; A47L 13/19
USPC ..... 15/104.93, 244.1, 244.3, 244.4
See application file for complete search history.

(56) References Cited

U.S. PATENT DOCUMENTS

2003/0228813 A1* 12/2003 Johnson ..... D06N 3/0063 442/101
2008/0127994 A1* 6/2008 Rippl ..... A61Q 5/00 15/104.94

FOREIGN PATENT DOCUMENTS

EP 0 068 830 A1 * 1/1983
WO WO 2016/186538 A1 * 11/2016

* cited by examiner

*Primary Examiner* — Randall E Chin

(57) ABSTRACT

An integrated chemical delivery and cleaning system is provided. The system includes a cleaning medium. The system also includes a plurality of chemicals infused into portions of the cleaning medium. The system further includes a plurality of membranes configurable within the cleaning medium and designed to compartmentalize a plurality of regions within the cleaning medium. Additionally, the system includes a surface layer positionable on a surface of the cleaning medium wherein the surface layer is structured to include materials designed to clean surfaces of objects.

5 Claims, 7 Drawing Sheets

INTEGRATED CHEMICAL DELIVERY AND CLEANING SYSTEMS

RELATED APPLICATIONS

This application claims priority to U.S. Provisional Application No. 62/941,921 filed Nov. 29, 2019. The entire contents of the above application are hereby incorporated by reference as though fully set forth herein.

FIELD OF THE INVENTION

The present invention relates to chemical delivery systems, and particularly to integrated chemical delivery and cleaning systems for providing end users chemical delivery systems which include chemical application sponges, wipes, and/or cleaning mediums which have the chemicals manufactured with the chemicals infused within the cleaning mediums.

BACKGROUND OF THE INVENTION

Previous attempts to create systems to deliver cleaning mediums with the appropriate chemicals included have been unsuccessful. In many instances, a variety of these systems still include acquiring separate cleaning mediums and chemicals, increasing human interaction and significant time expenditure to acquire them, human interaction and time-consuming activity to apply the chemicals to the cleaning medium, and human interaction and taxing time operations to clean up after cleaning evolutions. Further, these systems involve inefficient use of the chemical because quite often more chemical than is needed is applied, and the remaining chemicals get washed off the cleaning medium and results in an increase in waste effluent discharges. Consequently, resulting in increased costs and pollution.

The nature of acquiring separate cleaning chemicals and cleaning mediums has in the past involved generating waste. The waste comes from plastic and non-recyclable materials used in packaging, delivering, and storing these items. As the world's population increases the amount of waste involved in manufacturing and delivering chemicals and cleaning mediums has increased. This increase of waste adds to the problem of pollution and earth friendly waste management.

Cleaning involves time consuming evolutions such as acquiring chemicals and cleaning mediums. Most activities involved in cleaning household items, vehicles, inside and outside areas require extensive amount of human interaction and time-consuming activities. This time expenditure takes away from people's available time to do other things. If there existed systems to make these cleaning evolutions more efficient, it would increase quality of life for many people.

As the world's population increases, the need for cleaning chemicals and cleaning mediums such as sponges has increased. In areas throughout the United States and other countries, the amount of cleaning chemicals and cleaning mediums has increased. The current systems for utilizing chemicals and cleaning mediums has resulted in an increase in chemicals and sponges use which are used inefficiently. These inefficiencies result in waste. Further, due to the shelf life of some chemicals, there continues to be spoilage of chemicals. These inefficiencies result in waste, unavailability of chemicals in certain areas, and in increased costs to deliver chemicals.

Accordingly, there is an established need for chemical delivery and cleaning systems which solve at least one of the aforementioned problems. Further, there is an established need for integrated chemical delivery and cleaning systems, having various forms, that can help people clean while minimizing time actively involved in getting the chemicals and cleaning mediums and in cleaning up afterwards.

SUMMARY OF THE INVENTION

According to an aspect of the present invention, an integrated chemical delivery and cleaning system is provided. The system includes a cleaning medium. The system also includes chemicals, the chemicals infused into portions of the cleaning medium. The system further includes at least one membrane, the at least one membrane configurable within the cleaning medium to compartmentalize a plurality of regions of the cleaning medium. The plurality of regions structured to contain none, one, and/or a plurality of chemicals. Additionally, the system includes a surface layer structured to include materials such as but not limited to abrasive mediums, scratch pads, highly absorbent material, chamois, cloth, rags, towels, polishing cloths, buffing pads, and/or disintegrating materials.

According to another aspect of the present invention an integrated chemical delivery and cleaning system is provided. The system includes a cleaning medium. The system also includes a plurality of chemicals infused into portions of the cleaning medium. The system further includes a plurality of membranes configurable within the cleaning medium and designed to compartmentalize a plurality of regions within the cleaning medium. Additionally, the system includes a surface layer positionable on a surface of the cleaning medium wherein the surface layer is structured to include materials designed to clean surfaces of objects.

In an aspect, the system can include cleaning mediums including, but not limited to organic sponges, synthetic sponges, rags, wipes, cloths, cleaning swabs, towels, absorbent materials, and/or paper products.

In another aspect, the system can also include a plurality of chemicals, including but not limited to soaps, detergents, acidic solutions, alkali solutions, polishing solutions, wax solutions, buffing solutions, ceramic cleaning solutions, stainless steel cleaning solutions, water-based solutions, oil-based solutions both in liquid, powder, and/or solid forms.

In yet another aspect, the system can also include a plurality of membranes, the membranes configured to compartmentalize the cleaning medium into different regions. The membranes can include water resistant and/or solution resistant materials such that solutions on opposing sides of the membrane do not come into contact through the membrane. The regions can then contain different solutions and/or no solutions.

In an embodiment, the system can include chemicals infused throughout the cleaning medium, within different regions, in a gradient fashion, such that the concentration of chemical in the cleaning medium varies with position within a region.

In another embodiment, the system can also include chemicals infused throughout the cleaning medium homogeneously.

In yet another embodiment, the system can include chemicals encased within fibers of the cleaning medium.

In an aspect, the system can include chemicals encased in globules and/or pods. The globules and/or pods configured to be dissolvable in water, solvent, and/or oil. The globules and/or pods positionable in the cleaning medium.

In another aspect, the system can also include globules and/or pods of varying thicknesses configured to release chemical with varying pressures being applied.

In yet another aspect, the system can include a plurality of chemicals in a plurality of regions in the cleaning medium.

In an embodiment, the system can include sacrificial cleaning mediums wherein portions of the cleaning medium disintegrates after depleting infused chemical and/or after experiencing a predetermined amount of pressure, heat, temperature change, friction and/or amount of time exposed to a cleaning environment.

In another embodiment, the system can also include surface layers, the surface layers structured to provide abrasive mediums, scratch pads, highly absorbent material, chamois, cloth, rags, towels, polishing cloths, buffing pads, and/or disintegrating materials. The surface layers can provide a medium to polish and/or remove material abrasively. Further, the surface layers can include chemicals, the chemicals can be dispersed homogeneously, in a gradient fashion, varying concentrations, and can be based on position within the surface layers and/or the cleaning medium.

In yet another embodiment, the system can include scented chemicals.

In an aspect, the system can include sponges with dimensions of 1", 2", 6", 12" 24" 48" and/or any measurement in between for height, width, and/or length.

In another aspect, the system can include shapes and/or 3-dimensional structures such as but not limited to squares, rectangles, triangles, diamonds, circles, ovals, spheres, pyramids, tapered, cylinders, and/or trapezoids. The shapes designed to optimize cleaning of surfaces of cars, planes, trucks, household items, nooks, crannies, tight spaces, intricately shaped objects, and other specialty shapes associated with items needing to be cleaned.

These and other objects, features, and advantages of the present invention will become more apparent from the attached drawings and the detailed description of the preferred embodiments, which follow. It is understood, that the drawings are designed for the purposes of illustration and not as a definition of the limits of the embodiments of the present invention. It should be further understood that the drawings are not necessarily drawn to scale and are merely intended to conceptually illustrate the methods and systems described herein

BRIEF DESCRIPTION OF THE DRAWINGS

The features and advantages of the present invention will be better understood when the Detailed Description of the Preferred Embodiments given below is considered in conjunction with the figures provided. Further, the preferred embodiments of the invention will hereinafter be described in conjunction with the appended drawings provided to illustrate and not to limit the invention, where like designations denote like elements, and in which.

DETAILED DESCRIPTION

The following detailed description is exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
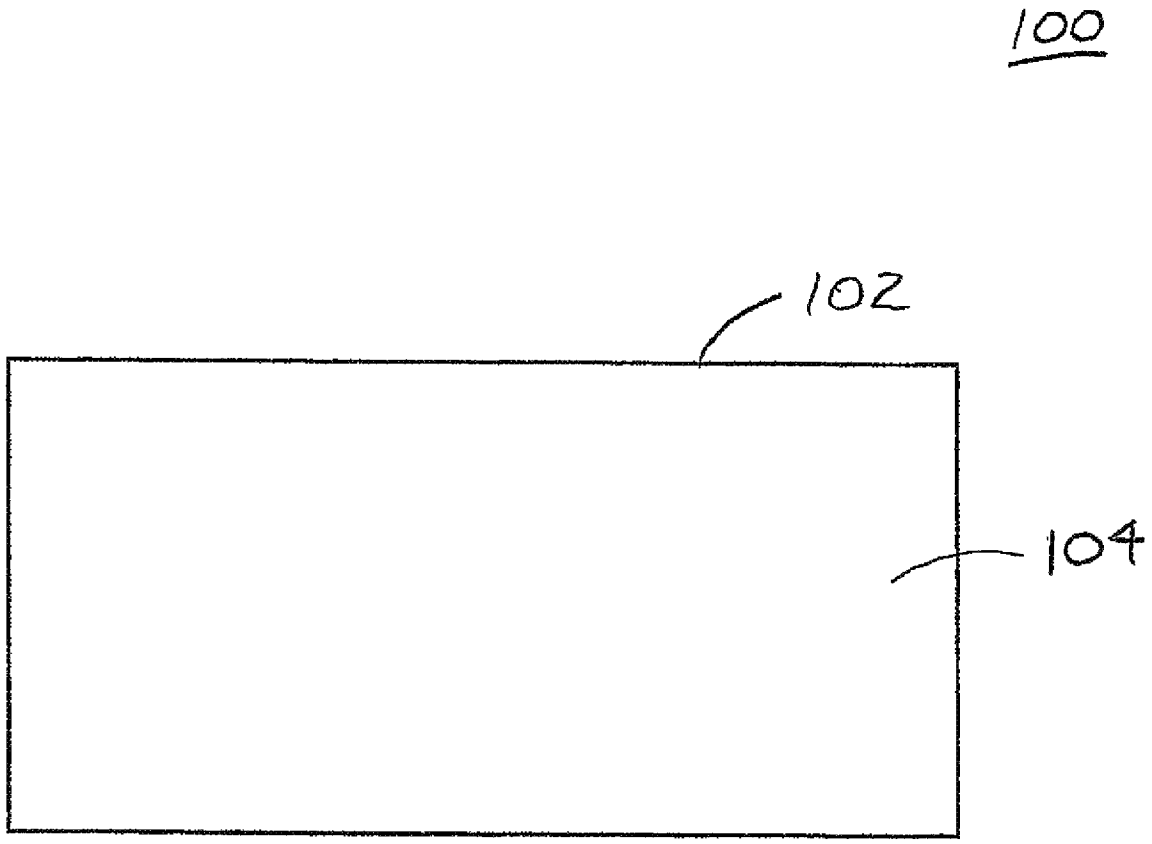
FIG. 1 is a top view of an embodiment of an integrated chemical delivery and cleaning system.

Referring to FIG. 1, a top view of an embodiment of the system is provided. The system can include a plurality of cleaning mediums and a plurality of chemicals. The chemicals can be infused within the medium in a plurality of fashions, including but not limited to homogeneously, in a gradient, dispersed based on a position within the cleaning medium. As seen in FIG. 1, the system 100 can include a cleaning medium 102 and the cleaning medium 102 can include a top 104.

Figure 2:
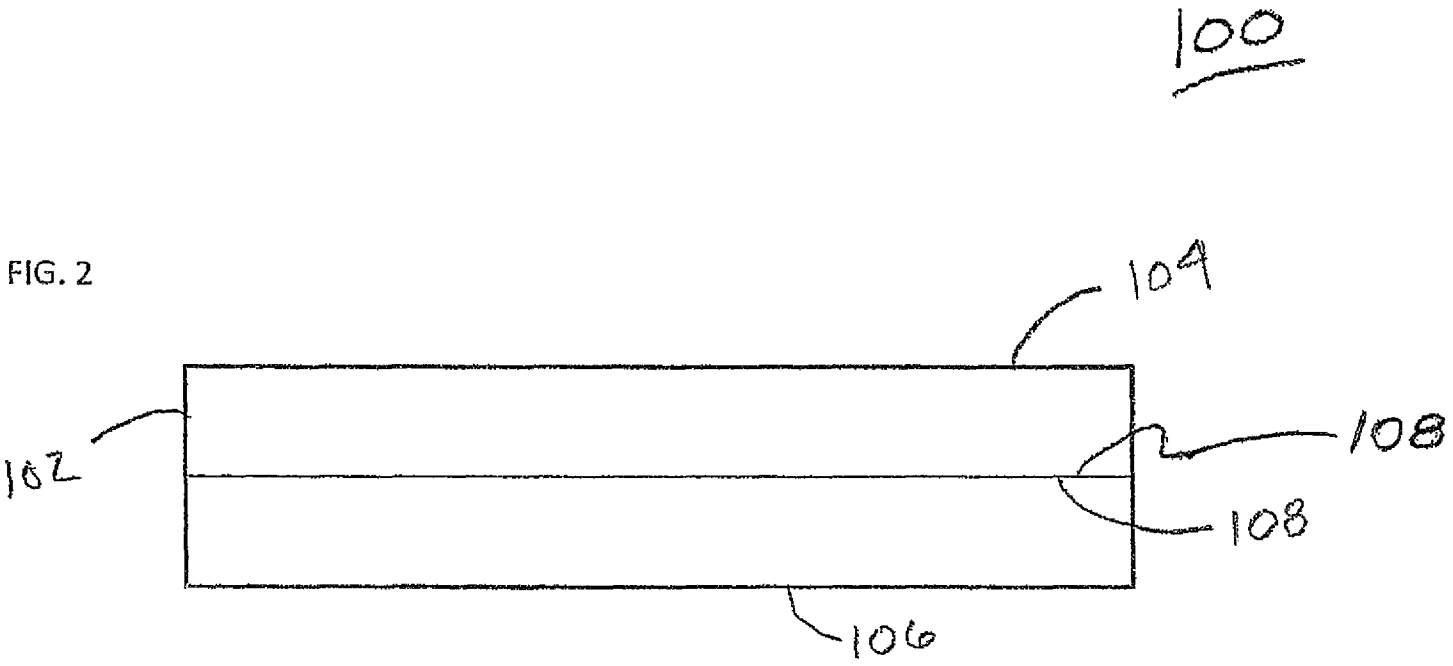
FIG. 2 is a side view of an embodiment of the present invention.

In FIG. 2 a side view of an embodiment is displayed showing a membrane positioned within the cleaning medium. The membrane can be positioned within the cleaning medium at a plurality of locations within the cleaning medium. The system 100 can include a cleaning medium 102 and can include a top 104 and a bottom 106. The cleaning medium 102 can include a membrane 108. The membrane structured to separate regions within the cleaning medium 102.

Figure 3:
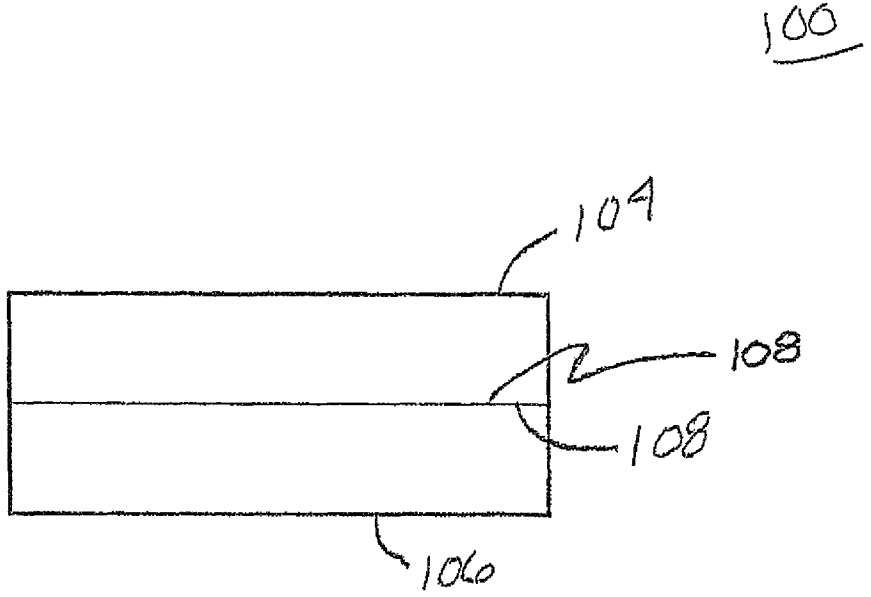
FIG. 3 is a front view of an embodiment of the present invention.

FIG. 3 illustrates a front view of an embodiment of the system pointing out a membrane within the cleaning medium. The membrane can include but is not limited to a non-porous, semi-porous, water soluble, non-water soluble, oil soluble, non-oil soluble, water resistant, oil resistant, and/or other materials configured to interact and/or prevent interaction with chemical within the cleaning medium. The cleaning medium 102 can include a membrane 108 that is horizontal and extends throughout the entire cleaning medium 102.

Figure 4:
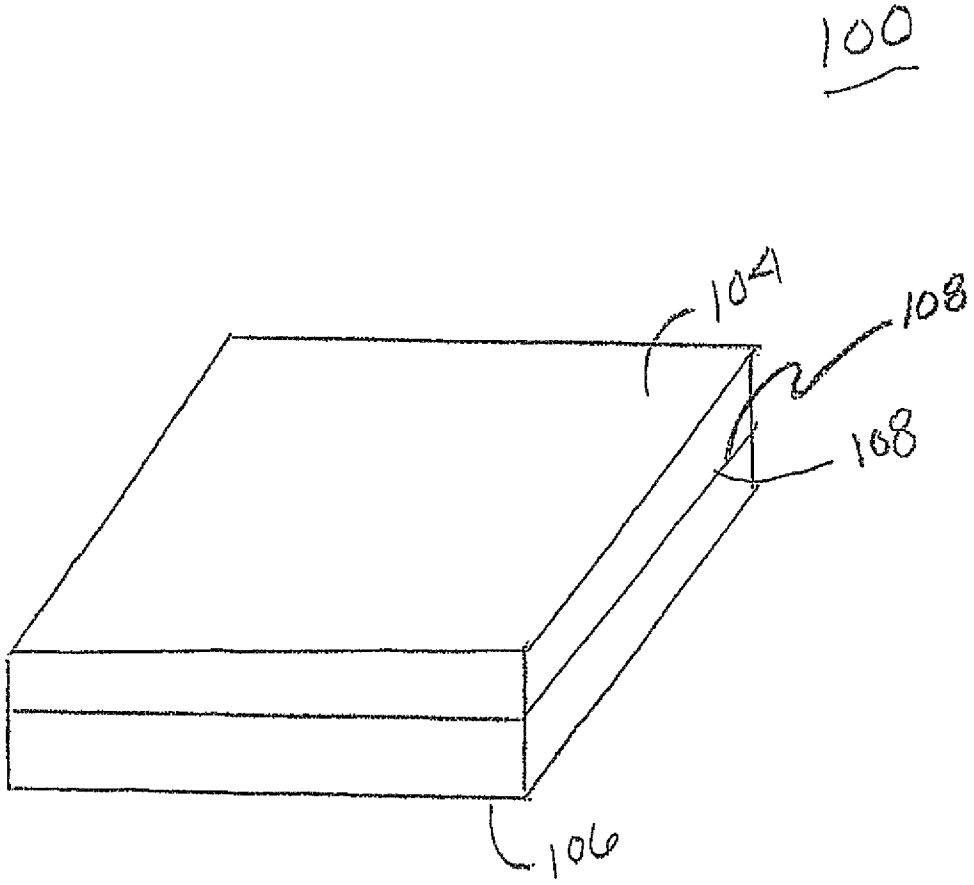
FIG. 4 is a perspective view of an embodiment of the present invention.

Turning to FIG. 4, a perspective view of an embodiment of the system illustrates a membrane within the cleaning medium. The membrane can be continuous throughout the cleaning medium. In embodiments not shown, the membrane can include a plurality of segments, the segments arranged to provide a cleaning strategy and/or a polishing strategy. As best seen in FIG. 4 the cleaning medium 102 can include a top 104 and a bottom 106 that are parallel to each other. Further, the cleaning medium 102 can include a membrane 108 that is also parallel to the top 104 and bottom 106 and separates the cleaning medium into regions.

Figure 5:
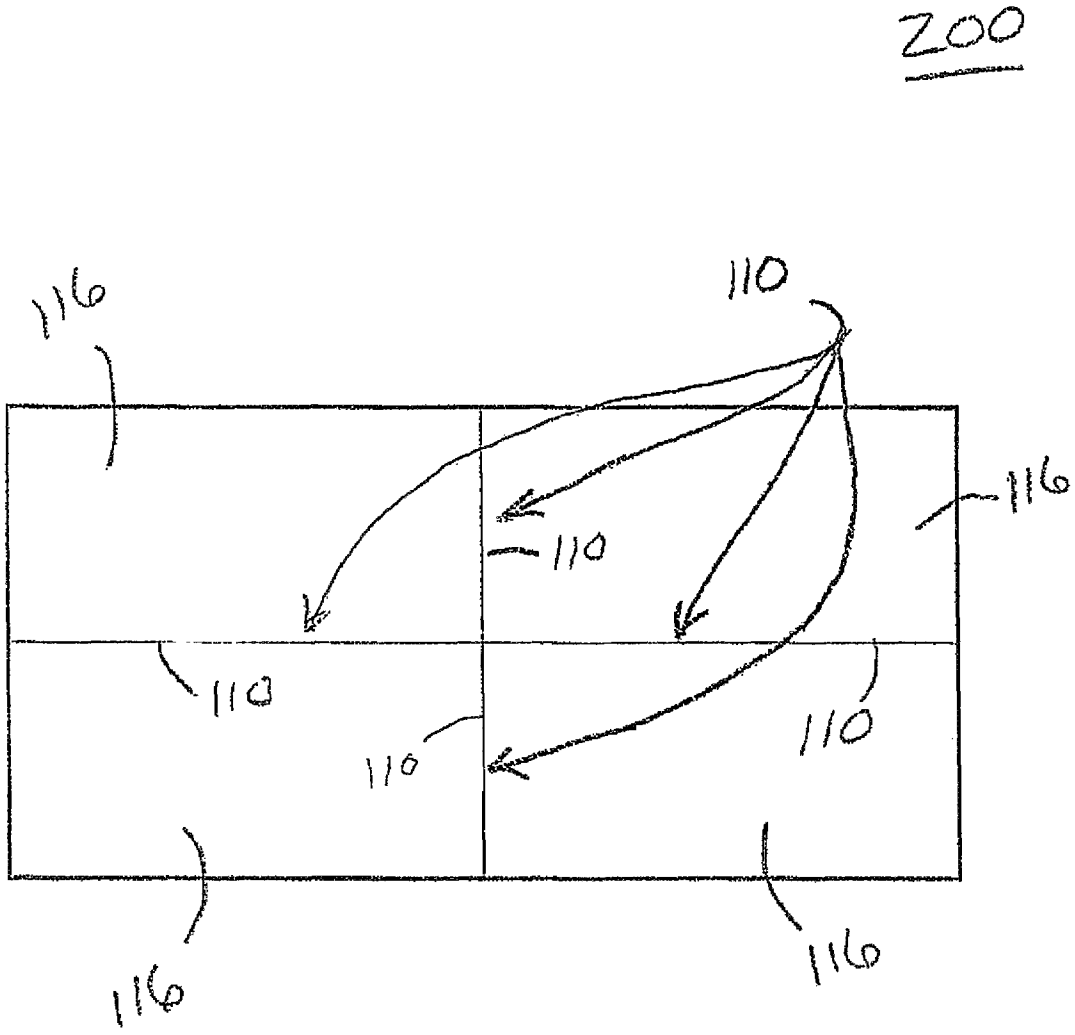
FIG. 5 is a top view with vertical membranes of an embodiment of the present invention.

FIG. 5 shows a top view of an embodiment of the system with vertical membranes within the cleaning medium. The membranes can be structured to provide a plurality of regions configured to contain a plurality of chemical in different regions. For example, a region may contain detergent, another may contain solvent, another may contain polish, another may contain acetone, another may contain water, another may contain water, and/or another may contain abrasive chemicals. FIG. 5 displays an embodiment of the present invention with a cleaning medium 102 which includes vertical membranes 110 dividing the cleaning medium 102 into different regions. The different regions can include a plurality of different chemicals 116 infused into the regions.

Figure 6:
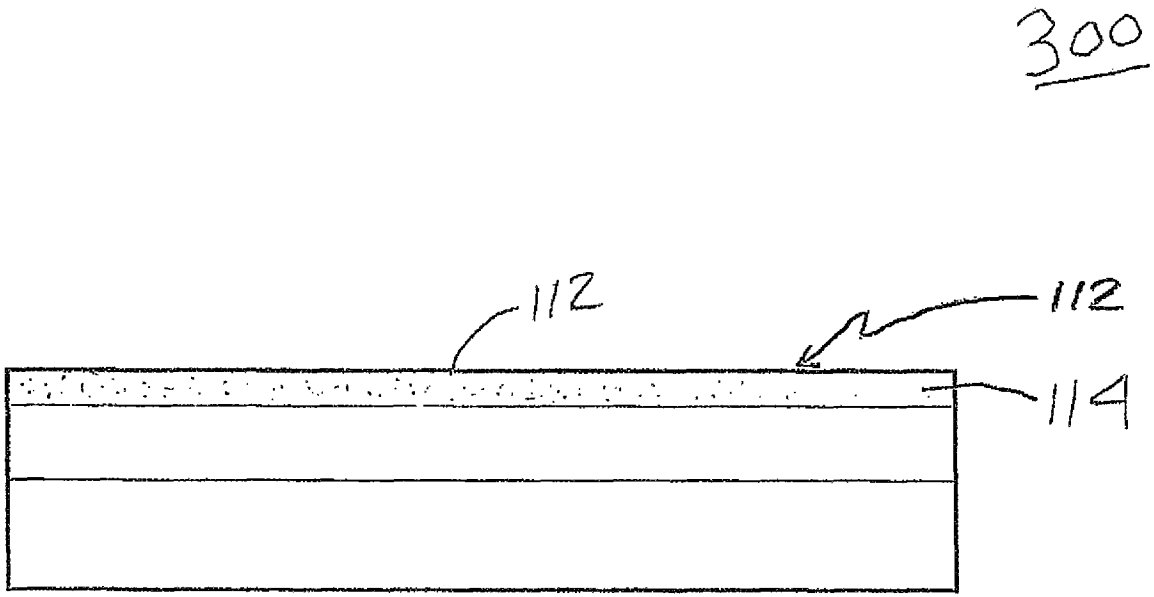
FIG. 6 is a side view of an embodiment of the present invention displaying a surface layer.

FIG. 6 displays a side view of an embodiment of the system with surface layers. The surface layers can include a plurality of materials. The surface layers structured to provide abrasive mediums, scratch pads, highly absorbent material, chamois, cloth, rags, towels, polishing cloths, buffing pads, and/or disintegrating materials. The surface layers can provide a medium to polish and/or remove material abrasively. Further, the surface layers can include chemicals, the chemicals can be dispersed homogeneously, in a gradient fashion, varying concentrations, and can be based on position within the surface layers and/or the cleaning medium. In the embodiment displayed in FIG. 6 the cleaning medium can include a surface layer 112. The surface layer can be designed to include cleaning materials. Further, in the embodiment as shown the cleaning medium can include infused chemicals 114 below the surface layer 112 designed to be deployed and activated upon having pressure applied.

Figure 7:
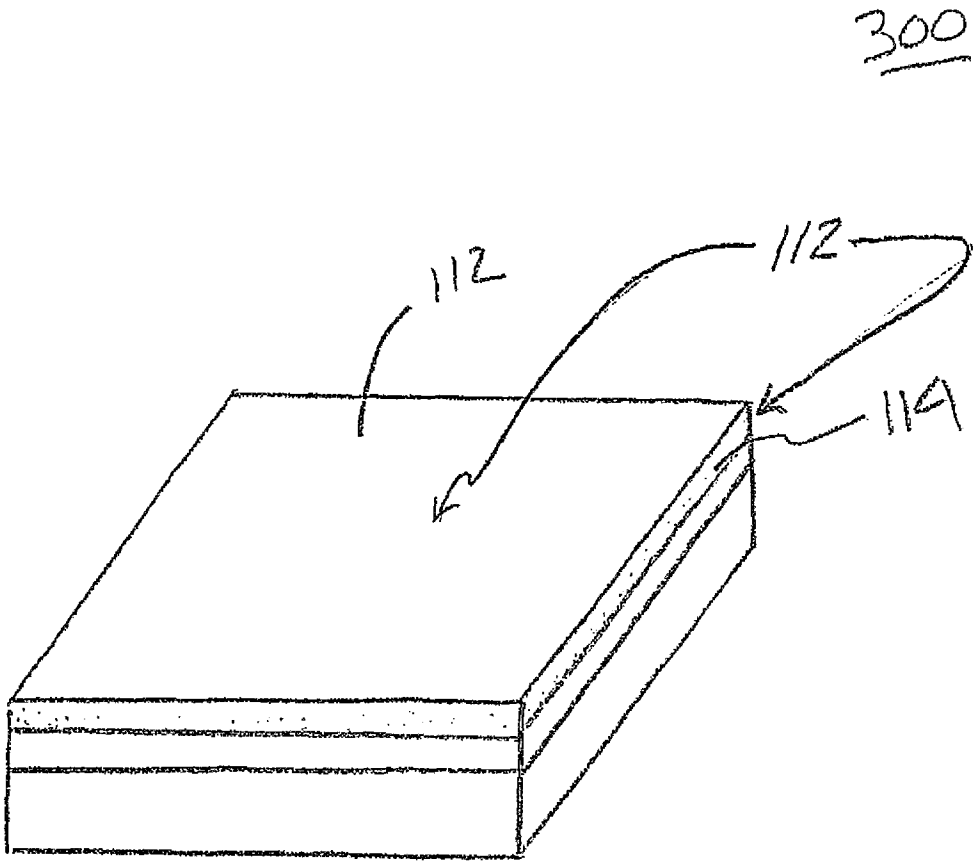
FIG. 7 is a perspective view of an embodiment of the present invention displaying a surface layer.

FIG. 7 illustrates a perspective view of an embodiment of the present invention with surface layers. In embodiments not shown the surface layers can include thicknesses including but not limited to 5, 10, 50, 75, 99 percent of the dimension of the cleaning medium and/or including any percentage in between. Turning to FIG. 7 an embodiment showing that the cleaning medium can include a surface layer 112 that is parallel to membrane 108 and covers the entire top 104 of the cleaning medium 102. Additionally, the cleaning medium 102 can include a chemical infused layer 114 below the surface layer 112 that is parallel to the surface layer 112.

While the foregoing written description of the exemplary embodiments enables one of ordinary skill to make and use what is considered presently to be the best mode thereof, those of ordinary skill will understand and appreciate the existence of variations, combinations, and equivalents of the specific embodiment, method, and examples herein. The exemplary embodiments should therefore not be limited by the above described embodiment, method and examples, but all embodiments and methods within the scope and spirit of the exemplary embodiments as claimed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

Insofar as the description above and the accompanying drawings disclose any additional subject matter that is not within the scope of the claims below, the inventions are not dedicated to the public and the right to file one or more applications to claim such additional inventions is reserved.

What is claimed:

1. An integrated chemical delivery and cleaning system comprising:

a cleaning medium, and wherein the cleaning medium includes portions of the cleaning medium which disintegrate after depleting infused chemical and/or after experiencing a predetermined amount of pressure, heat, temperature change, friction and/or amount of time exposed to a cleaning environment;

a plurality of chemicals infused into portions of the cleaning medium, the chemicals infused throughout the cleaning medium, within different regions, in a gradient fashion, such that the concentration of chemical in the cleaning medium varies with position within a region; and wherein the chemicals are encased within fibers of the cleaning medium; and wherein the chemicals are encased in globules and/or pods; and wherein the globules are of varying thicknesses configured to release chemical with varying pressures being applied;

a plurality of membranes configurable within the cleaning medium and designed to compartmentalize a plurality of regions within the cleaning medium; and a surface layer positionable on a surface of the cleaning medium wherein the surface layer is structured to include materials designed to clean surfaces of objects, and wherein the surface layer can include chemicals, the chemicals dispersed, in a gradient fashion, of varying concentrations, and are based on a position within the surface layer.

2. The system of claim 1 wherein the surface layer includes abrasive scratch pad material.

3. The system of claim 1 wherein the plurality of chemicals are infused into the plurality of regions with different chemicals.

4. The system of claim 1 wherein the cleaning medium includes a sponge.

5. The system of claim 1 wherein the plurality of chemicals includes soap.

* * * * *